United States Patent [19]

Parsons et al.

[11] Patent Number: 4,953,769

[45] Date of Patent: Sep. 4, 1990

[54] BATON CLIP

[76] Inventors: Kevin L. Parsons, 16 Wagon Wheel Dr., Appleton, Wis. 54915; Gary M. Grundy, 921 E. Hamilton St., Milwaukee, Wis. 53201; Jacqueline M. Dunstan, 604 Aspen St., South Milwaukee, Wis. 53172

[21] Appl. No.: 332,237

[22] Filed: Mar. 31, 1989

[51] Int. Cl.[5] ..... A45F 5/00

[52] U.S. Cl. ..... 224/247; 224/250; 224/253; 224/914

[58] Field of Search ..... 224/193, 197, 200, 231, 224/247, 250, 251, 253, 914, 35; 273/84 R

[56] References Cited

U.S. PATENT DOCUMENTS

| | | | |
|---|---|---|---|
| 162,055 | 4/1875 | Goss | 224/251 X |
| 372,000 | 10/1887 | Wintz | 224/914 X |
| 710,236 | 9/1902 | Audley | 224/914 X |
| 969,524 | 9/1910 | Condon | 224/253 X |
| 3,307,754 | 3/1967 | Anketell | 224/914 X |
| 3,596,964 | 8/1971 | Zazzara | 224/251 X |
| 4,006,851 | 2/1977 | Kippen | 224/914 X |
| 4,286,741 | 9/1981 | Rogers | 224/193 |
| 4,355,804 | 10/1982 | Bingham | 273/84 R |
| 4,424,923 | 1/1984 | Bingham | 224/251 |
| 4,662,552 | 5/1987 | Uyehara | 224/251 |

*Primary Examiner*—Henry J. Recla
*Assistant Examiner*—R. M. Fetsuga
*Attorney, Agent, or Firm*—Quarles & Brady

[57] ABSTRACT

A baton clip adapted for lateral withdrawal, or "break out" of a baton includes a retaining ring specifically formed to produce a loud snapping sound as the baton is broken out. The loud snapping sound has been found to produce a shock, or stunning psychological effect on a potential adversary, which often results in passive submission, solely by breaking the baton out. The clip is further provided with a closure for positively securing the baton in the clip. The closure is constructed and arranged in such a way as to provide for release of the closure and withdrawal of the baton in a single, rapid, uninterrupted, and fluent motion.

4 Claims, 3 Drawing Sheets

FIG. 5
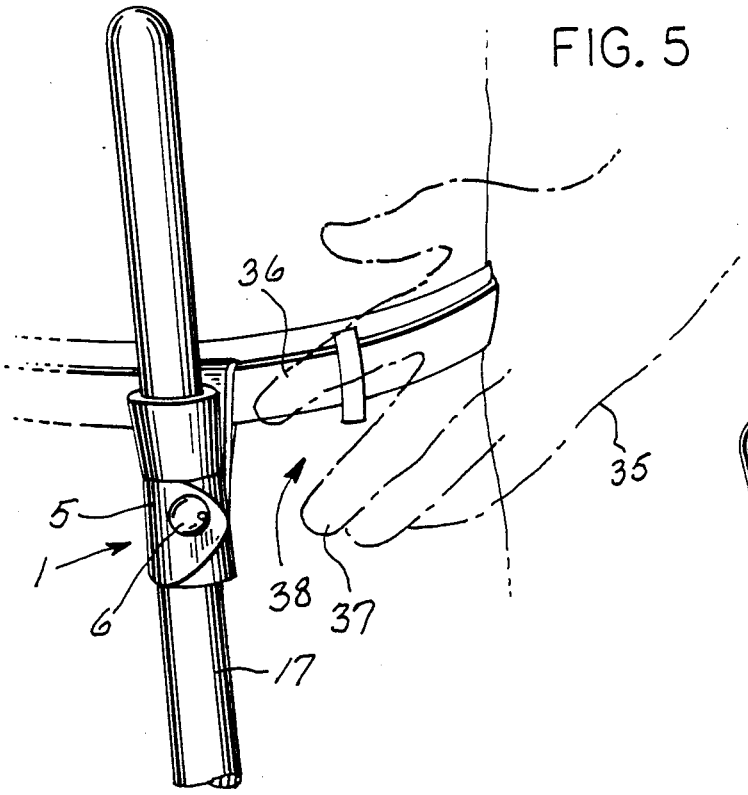
FIG. 6
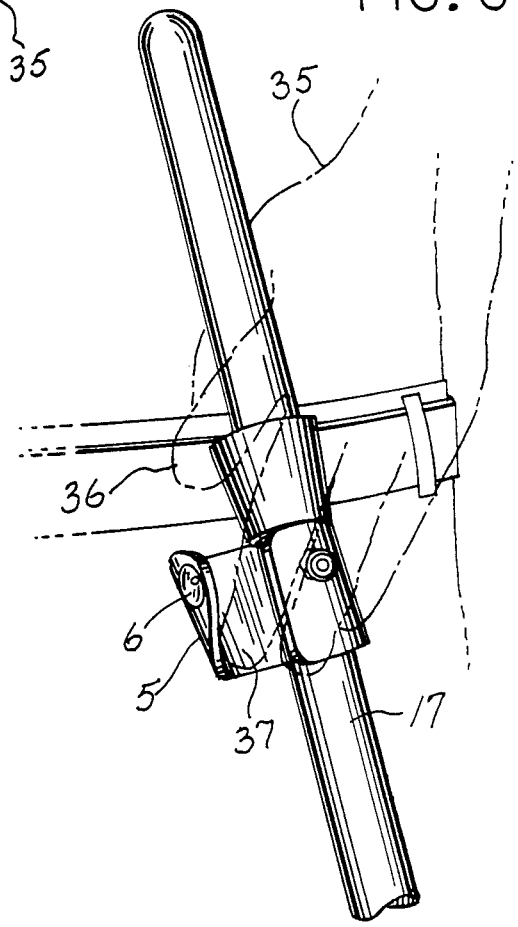
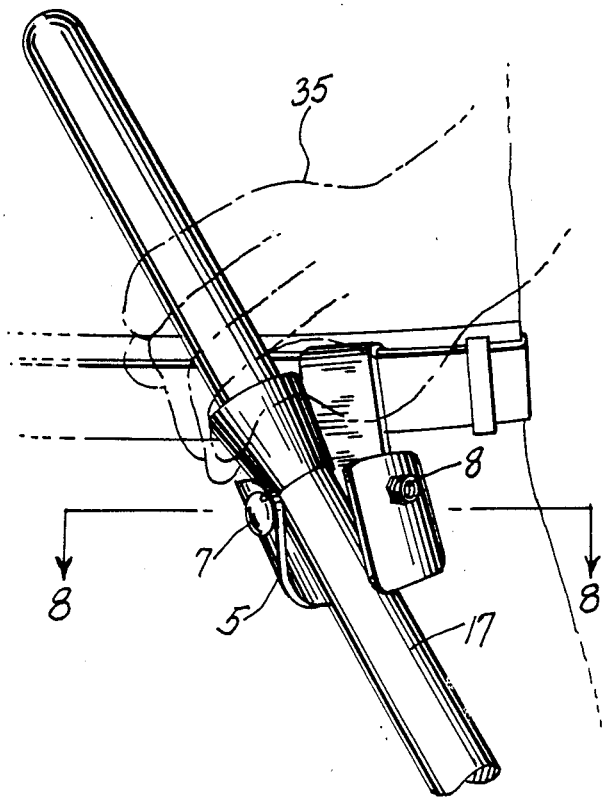
FIG. 7

BATON CLIP

BACKGROUND OF THE INVENTION

The field of the invention is baton holders, or clips, and more particularly, baton clips of the type in which the baton may be removed laterally, or "broken out" of the clip.

Probably the most commonly used type of baton holder is the fixed ring type, such as that described in U.S. Pat. No. 3,307,754. With fixed ring baton holders, the baton can only be removed by drawing the baton out axially. A stopper with a diameter greater than the diameter of the ring is provided on the baton handle to prevent the baton from passing completely through the ring. The axial withdrawal is a relatively slow maneuver, requiring substantial motion to draw the baton.

Other types of baton holders, or clips, are known which allow the baton to be deployed laterally, or "broken out" as it is referred to in the art. Examples of lateral draw clips are shown in U.S. Pat. Nos. 372,000; 710,236; 969,524; and 4,006,851. Lateral draw clips may employ a closure means in the form of a strap or clasp which prevents the baton from being broken out until the closure means has been released, The closure means thereby prevents the baton from being released from the clip inadvertently, or from being "grabbed away" by an adversary. The aforementioned patents U.S. Pat. No. 710,236 and U.S. Pat. No. 4,006,851 include such closure means.

Lateral draw clips have an advantage over ring type clips in that the baton is generally held more securely and can be deployed more rapidly. However, when closure means are employed, an extra step is included in the deployment process, e.g. releasing the closure means. Of course, is is possible to release the closure means well in anticipation of baton withdrawal, however such a procedure only mitigates the advantages of the closure means between the time that the closure means is released and the time that the baton is actually drawn. There is therefore a need for a lateral draw baton clip including closure means in which the closure means is easily and simply released essentially simultaneously with lateral withdrawal of the baton.

SUMMARY OF THE INVENTION

An important discovery of this invention is that the production of a loud, snapping sound as the baton is broken out of a clip according to this invention has a profound psychological effect on a potential adversary. Accordingly, a clip of the present invention includes a retaining ring for holding the baton. The retaining ring includes a longitudinal break, through which the baton may be broken out. The longitudinal break is defined by opposed longitudinal edges on the retaining ring. In order to produce the loud snapping sound as the baton is broken out, the longitudinal edges are arranged in close proximity to each other in a relaxed state and are formed of a hard material. The retaining ring is deformable away from the relaxed state, e.g. in order to break the baton out. Once deformed, the retaining ring has a high restorative force towards the relaxed state. When the baton is broken out, the retaining ring is deformed to a point where the longitudinal break is equal to the diameter of the baton, thereby allowing the baton to pass through, or be "broken out". Then, as the shaft of the baton clears the longitudinal break, the longitudinal edges of the retaining ring rapidly accelerate towards each other, eventually colliding together at high speed. Because of the hard surface on the longitudinal edges, the above mentioned collision produces the loud snapping noise characteristic of this invention.

Another objective of the invention is to provide a clip which includes a closure strap, and which enables rapid lateral breakout of the baton, even with the closure strap fastened. The retaining band in a clip according to the invention is attached to the base member in such a way that the longitudinal break is oriented in a generally front facing position. The retaining band includes a first half of a unidirectional snap positioned near the outer rear quadrant of the retaining band. A closure strap is attached to the base member and extends around the front of the retaining band, terminating in a terminal end. The closure strap includes a second half of a unidirectional snap near the terminal end which mates to the first snap half on the retaining band, the two unidirectional snap halves being oriented such that a release point of the snap halves is directed toward the terminal end of the closure strap. The closure strap thereby prevents the baton from being broken out through the longitudinal break when the two snap halves are engaged. Further, the closure strap is formed of a pliable material which allows the closure strap to deflect outwardly, allowing break out of the baton when the two snap halves are released. The unique construction according to the invention enables a single uninterrupted stroke of the users hand to both firstly wedge a digit of the users hand under the terminal end of the closure strap to release the two snap halves, and then secondly continue the stroke to break out the baton through the longitudinal break in fluent succession.

Another object of the invention is to form the clip simply and economically using a minimum of material and at the same time providing a neat appearance and ease of assembly and use. The clip may advantageously be formed including an attachment strap connected on one end to the base member, and a second snap for releasably connecting the other end of the attachment strap to the base member, thereby defining belt loop suitable for encircling a belt worn by the user. The base member, closure strap, and attachment may all be formed from a single L-shaped piece of material.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIGS. 5–7 are a time sequence series of side views illustrating a first operational use of the baton clip of FIG. 1;

DESCRIPTION OF THE PREFERRED EMBODIMENT

Figure 1:
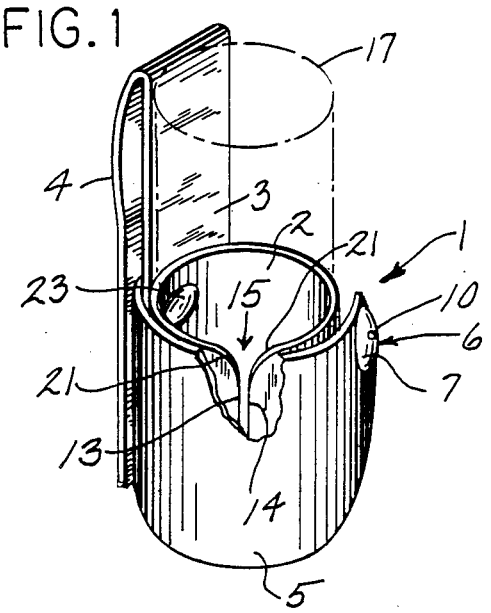
FIG. 1 is a perspective view of a baton clip according to the present invention.
Figure 2:
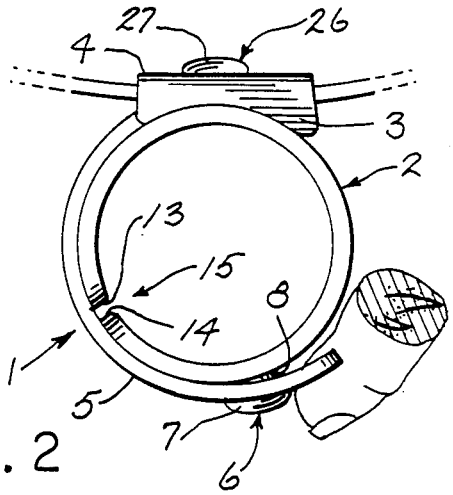
FIG. 2 is a top view of the baton clip of FIG. 1.

Referring to FIGS. 1 and 2, a baton holder, or clip 1 includes a retaining ring 2 attached to a backing, or base member 3. As illustrated in FIG. 1, the base member 3 may also include means for attaching to the belt of a user, for example, by using an attachment strap 4. Other known means for attaching holsters, accessory cases, and other similar articles such as, for example, snaps for directly snapping onto user's belt, are equally usable with his invention. A closure strap 5 extends from the base member 3, around the front of the retaining ring 2, and terminates in the outer rear quadrant of the retaining ring 2. The closure strap 5 is releasably secured to the retaining ring 2 by means of a unidirectional snap assembly 6 comprised of two snap halves 7 and 8. Unidirectional snaps of the type used in this embodiment are generally known in the art, and are releasable only by the application of force to separate the snap halves at a release point, usually indicated by a dimple 10 or other mark on the cap, or female snap half 7.

The retaining ring 2 is formed of a stiffly resilient, or spring material. In this particular embodiment, the material preferred for the retaining ring 2 is a thermo-settable plastic material known in the art under the trade name "KYDEX". The KYDEX material is preferred because it can be easily formed to the desired shape using known thermo setting methods. The KYDEX retaining ring 2 also possesses other qualities which are beneficial in meeting the objectives of this invention, as described in detail below.

The retaining ring 2 includes two longitudinal edges 13 and 14 which define a longitudinal break 15. A baton 17 is insertable through the retaining ring 2. It is preferred that in its relaxed, or unflexed state, the retaining ring 2 has an inside diameter which is slightly smaller than the outside diameter of the baton shaft 17. In that case, the baton shaft 17 may be relatively easily inserted, spreading the longitudinal break 15 slightly open, to the position shown in FIGS. 1 and 2. Once inserted, the retaining ring 2 is under a slight amount of tension, just enough to keep the baton from moving completely freely in the clip even with the the closure strap released. At the same time, the tension is small enough to allow easy axial removal of the baton in addition to a "front break" capability described below. The tension provided by the retaining ring 2 is an advantage over prior "ring" type baton holders, in which the baton may swing excessively or "bounce" during exaggerated physical movements.

Figure 3:
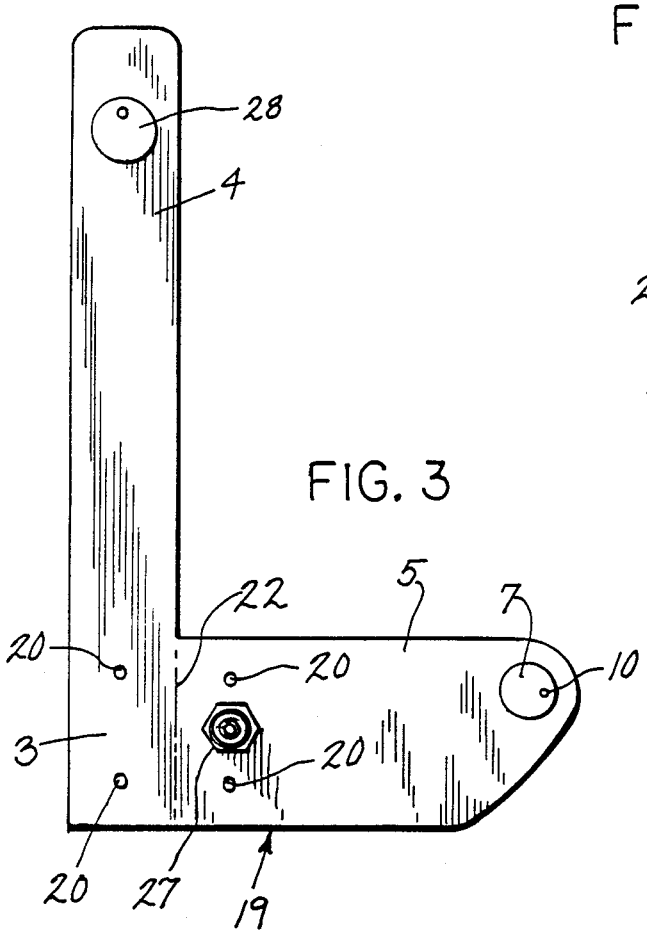
FIG. 3 is an elevational view of a partial assembly of the baton clip of FIG. 1.
Figure 4:
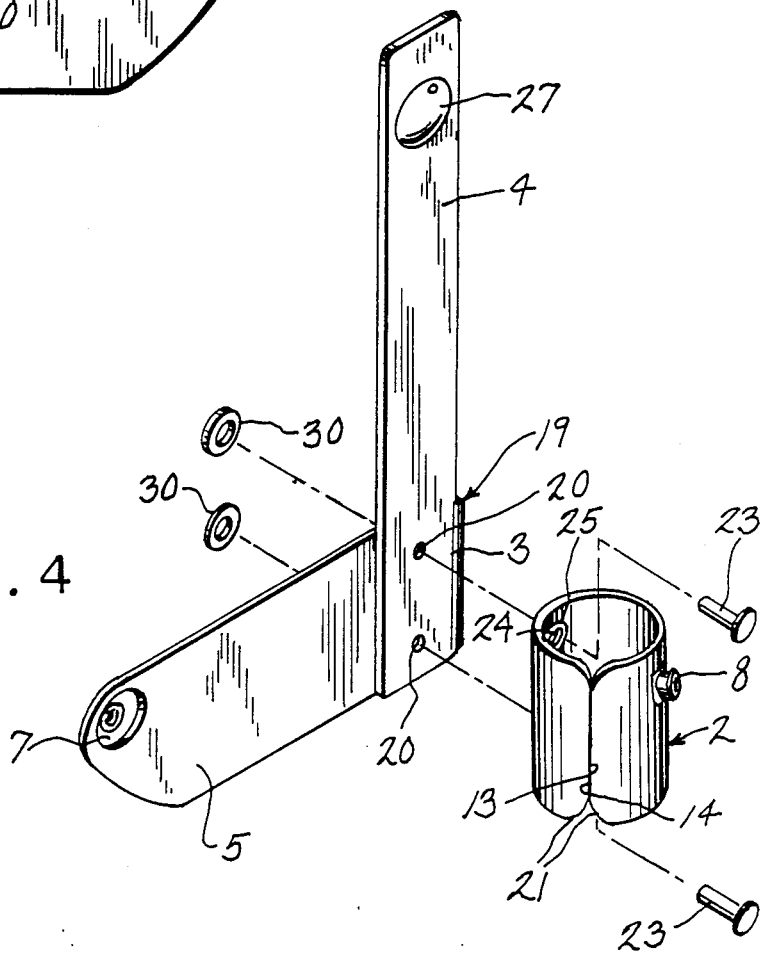
FIG. 4 is an exploded perspective view illustrating the assembly of the baton clip of FIG. 1.

Before describing the advantageous operational features of the clip 1, the unique structural details of the clip 1 are now described, primarily in relation to FIGS. 3 and 4. In FIG. 3, a preferred construction for the clip 1 is shown as comprising a single "L" shaped piece of leather 19 which integrally forms the base member 3, attachment strap 4, and closure strap 5. The "L" shaped leather piece 19 is first cut to size from a suitable thickness of leather stock, with stock of approximately 7 ounces per square foot being preferred for strength and durability. Then, a set of four holes 20 are punched symmetrically across a fold line 22. The fold line 22 is scored by cutting a "V" groove on the back side of the piece 19. As shown in FIG. 4, the leather piece 19 is eventually folded along fold line 22, causing the holes 20 to line up to receive rivets 23 for fastening the retaining ring 2 onto the base member 3.

Still referring to FIG. 3, before folding the piece 19, the cap 7 for snap 6 is set onto the end of closure strap 5. Also, a second unidirectional snap 26 (seen in FIG. 2) is provided for securing the attachment strap 4 to the base member 3. The snap 26 comprises a male half, or stud 27 attached on the bottom of the "L", and a female half, or cap 28 attached on the end of the attachment strap 4. The snap halves 7, 27 and 28 are easily set before the piece 19 is folded using known snap setting machinery. Then, when the piece 19 is folded into the position of FIG. 4, the stud 27 is pointing away from the base member 3 to receive the cap 28. Additionally, the back of stud 26 is covered by base member 3, thereby providing a neat appearance and preventing abrasion.

Referring now to FIG. 4, the retaining ring 2 is formed before joining to the folded piece 19 as follows. The KYDEX material is manufactured as flat sheets (not shown). A flat strip (not shown) which is to be formed into the ring 2 is cut from the sheet having a width equal to the desired height of the retaining ring 2, and having a length approximately equal to the desired diameter of the ring 2 in the relaxed state.

The spring tension of the formed KYDEX ring is dependent on both the axial length of the ring 2 and the thickness of the KYDEX material used. Since a primary objective of this invention is the production of a loud snapping sound as the baton 17 is broken out of the clip 1, the axial length for the retaining ring 2 is important for two reasons. First, for any given thickness of the ring 2, a greater axial length will result in a higher spring coefficient, and thus a louder sound produced when the longitudinal edges 13 and 14 are thrust together. Secondly, a greater axial length results in a greater surface area contact between the longitudinal edges 13 and 14 when they collide, also resulting in a louder sound. In that regard, the axial length also has an effect on the pitch, or resonant frequency of the sound produced, although the pitch is not as important as the sheer magnitude and sharpness of the sound. A wide range of axial lengths, or heights, are acceptable, and are not a limiting factor in this invention so long as a snapping sound is produced. As such, heights as small as ½ inch may be used for the retaining band, although the sound produced would not be as loud as with longer retaining rings 2. A preferred height for the retaining ring 2 is approximately 1⅞ inches.

The thickness of the KYDEX ring 2 is also a factor in determining the spring coefficient of the ring 2 in that a greater thickness increases tension and therefore also increases the magnitude of the sound produced for any given axial length. However, too much spring tension also impedes lateral breakout of the baton. A preferred thickness for the KYDEX used in forming the ring 2 is approximately 3/32 of an inch.

As stated above, the diameter of the ring 2 is dependent on the diameter of the baton shaft 17. A common shaft diameter is 1.25 inches, in which case an inside diameter for the ring 2 of 1.18 inches would be satisfactory. The corners of the flat strip are then rounded off so that once the ring 2 is formed, the corners 21 for the longitudinal break 15 are smoothly rounded to facilitate sideways break-out of the baton 17 without marking.

With the strip still flat, three holes are drilled and counterbored (one such hole 24 and counterbore 25 being visible in FIG. 4); two for the rivets 23 to pass through, and one to receive a rivet (not shown) for attaching the stud 8. The counterbores 25 are preferably to a depth approximately equal to the thickness of the respective heads on the rivets 23 or the stud 8 rivet, thereby recessing the heads to prevent abrasion on the baton shaft 17. The recess for the stud 8 rivet also facilitates setting of the stud 8 while the strip is flat, without interfering with the forming of the strip into the ring 2.

After forming the holes 24 and counterbores 25, and setting the stud 8, the flat strip is formed into the cylindrical shape used for the ring 2. The process for thermoforming the KYDEX strip into the ring 2 is generally known in the art, and comprises the steps of (1) heating the KYDEX until it softens, and then (2) forming the KYDEX into the desired shape. In this case, to form the ring 2, a cylindrical post (not shown) is used as a mold around which the softened KYDEX is held until cooled. An outer hollow cylindrical metal mold (not shown) may be advantageously used for holding the KYDEX tightly around the post, which also serves as a heat sink for accelerating the cooling process.

The KYDEX material has the characteristic of shape "memory"; it retains the form in which it is thermo-set. Then when cooled, the KYDEX is essentially an elastic spring, allowing deformation against a tension supplied by the KYDEX. When released, the KYDEX restores to its programmed shape. The formation and the resulting shape of the ring 2 are important parts of this invention, which are described in detail below.

Once formed, the ring 2 is riveted onto the base member 3 using rivets 23 and rivet backs 30. The attachment and closure straps 4 and 5, respectively, can then be folded and secured via their respective snaps 6 and 26, as shown in FIGS. 1 and 2.

As mentioned above, the clip 1 allows the baton 17 to be "broken out" by forcing the baton 17 laterally through the longitudinal break 15. While "break out" baton clips are generally known in the art, the clip 1 according to the invention provides advantages not found in such prior clips.

One important aspect of this invention is the production of a loud snapping noise when the baton shaft 17 is broken out through the longitudinal break 15. Prior baton clips of this type have generally comprised spring steel bands with which have been leather covered, both to protect the baton shaft from the spring steel and for esthetic appearance. Baton holders of this type are often used by policemen and other law enforcement agencies. As such, the user's of such baton holders are often subjected to potentially violent situations which precipitate withdrawal of the baton. Applicants have determined that in such a crisis situation, the production of a loud, sharp snapping noise as the baton is broken out elicits a shock effect in potential adversaries. The psychological effect of the snapping noise, and the resulting shock, has a stunning, or tranquilizing effect, which in many cases results in passive submission of the potential adversary. In other words, merely breaking the baton out of a case according to the present invention is in many cases sufficient to subdue a subject, solely from the loud snapping noise produced.

To produce the loud snapping noise as the baton is broken out, several factors are important. First of all, the longitudinal edges 13 and 14 must be formed of a hard substance capable of producing the sharp snapping noise. The leather coverings around the longitudinal edges in prior baton clips of this type are wholly unsuitable, resulting only in a subdued "thud". The KYDEX material preferred for this embodiment possesses the requisite hardness for sound production, but is not hard enough to mar the baton shaft. Therefore leather or other coverings are not necessary. Secondly, the longitudinal break 15 must be small enough in an unflexed, or relaxed state (e.g. without the baton shaft 17 inserted) so that the longitudinal edges 13 and 14 will be thrust into physical contact when the baton is broken out to produce the desired sound. Thirdly, the retaining ring 2 must have a relatively high spring tension, or stiffness, so that after the baton is broken out, the longitudinal edges 13 and 14 are thrust together with sufficient velocity to produce sufficient loudness for the snapping noise. In that regard, the snapping noise produced should be as loud as possible for maximum psychological effect, without making the retaining ring 2 so stiff as to hinder baton break out.

The preferred form for the retaining ring 2 capable of producing the loud snapping noise upon break-out of the baton can now be described. The longitudinal break 15 must not present an excessively wide gap with the ring 2 in a relaxed state, e.g. no KYDEX spring tension, or else the edges 13 and 14 will not snap together after breaking out the baton 17. In the preferred form, the mold used for forming the ring 2 is sized such that the longitudinal edges 13 and 14 of the formed ring 2 are in close proximity to each other. After the KYDEX cools, there is normally some residual tension, causing a slight further contraction of the ring 2 after removal from the mold before the relaxed state is achieved. By closely spacing the edges 13 and 14 during the molding, the residual tension is sufficient to actually bring the edges 13 and 14 into contact. In that case, the ring 2 cannot actually assume its relaxed state, since the contact between edges 13 and 14 prevents further contraction. This preferred form, e.g. with edges 13 and 14 in contact, is illustrated by the ring 2 in FIG. 4.

As noted above, the gap between edges 13 and 14 shown in FIGS. 1 and 2 is due to the insertion of the baton 17, and without it, the ring 2 assumes to the FIG. 4 configuration. The contact between edges 13 and 14 thereby holds the retaining ring 2 at a minimum diameter which is large enough to easily receive the shaft 17 of the baton. Then, when the shaft 17 is inserted, the longitudinal break 15 is opened to a width of approximately ⅛ inch. The retaining ring 2 is then under a small amount of tension, as described above, which tends to hold the baton shaft 17 fairly securely in the clip 1 even when the snap 6 is released.

It is not absolutely necessary for the edges 13 and 14 to touch before reaching a relaxed state. A relaxed state for the ring 2 which presents a small gap (not shown) in the longitudinal break 15 is acceptable. In that case, when the baton 17 is broken out, the edges 13 and 14 will fly past the neutral, or relaxed point due to momentum and contact each other to produce the desired noise. However, the gap width in the relaxed state, if present, should be kept as small as possible.

A second advantage of the clip 1 according to the invention is that because of the unique placement and construction of the closure strap 5 and closure snap 6, it is possible to release the snap 6 and break out the baton 17 in rapid succession using a single, continuous motion. The single motion release feature of this invention is illustrated in FIGS. 5–7. It is usually desired to keep the closure snap 6 fastened, to hold the baton securely, and also to prevent an adversary from grabbing the baton away. However, when the user has a need to draw the baton, it is often in a crisis situation in which rapid deployment of the baton, without undoing complicated catches and latches, is crucial.

In a clip 1 according to the invention, positive retention is provided for the baton 17 with the closure strap 5 fastened. Because of the unidirectional snap 6, the baton 17 cannot be broken out unless the snap 6 is open. A specific action is required to release the snap 6, e.g. lifting the terminal end of the closure strap 5 to pry out on the release point 10 The baton cannot be simply "grabbed" away without first releasing the snap 6. It is therefore difficult for an adversary to take the baton from the clip 1. Further, it is known that with prior fixed ring type baton holders, it is possible for an assailant to grab the baton handle and use it as a lever to force the baton between the legs of the person wearing the baton holder. The present invention also provides for an escape from that scenario, in that the snap 6 may be released and the baton will break out of the clip 1 rather than having the clip act as a fulcrum. At the same time, the novel construction of the clip 1 allows the user to rapidly deploy the baton with a single forward thrust of one hand to first open the snap 6 and then, in rapid succession, to break out the baton 17.

Referring to FIG. 5, a user's hand 35 is poised at the beginning of the withdrawal motion. The baton 17 and clip 1 are normally worn on the left side, since most people are right handed and batons are usually carried by security or law enforcement personnel who also carry a firearm on their right side. The hand 35 illustrated is therefore the left hand, although it should be apparent that a mirror image construction would enable corresponding right hand use. In the FIG. 5 position, it should be noted that the closure snap 6 is fastened. As the user's hand begins a forward motion towards the baton 17, the index finger 36 is slightly spread from the middle finger 37, shown generally at 38.

In the FIG. 6 position, the hand 35 has moved into contact with the baton 17 and clip 1. The thumb and index finger grasp around the baton handle. At the same time, the inner edge 40 of the middle finger 37 has wedged under the terminal end of closure strap 5. The uninterrupted forward motion of the hand 35 prize out on the closure snap 6 and releases it. A top view of the position of middle finger just prior to wedging the closure snap 6 open is shown in detail in FIG. 2.

Figure 8:
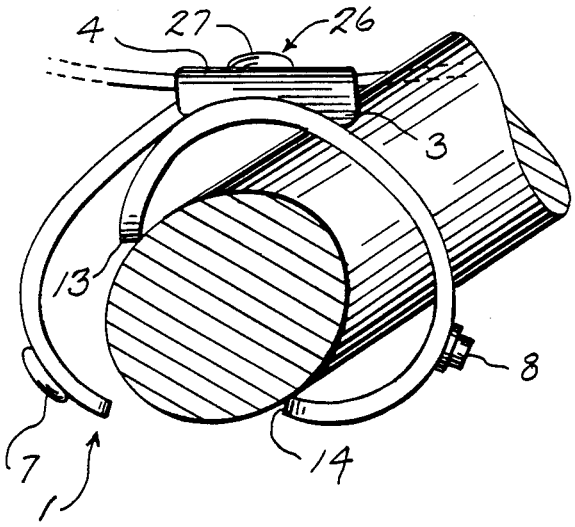
FIG. 8 is a sectional view taken on line 8—8 of FIG. 7.

Finally, in the FIG. 7 position, with the closure strap 5 released, continued forward motion of the hand 35 breaks the baton 17 out through the longitudinal break 15. As shown in FIG. 8, the longitudinal break is inclined towards the front of the clip 1 to facilitate breaking the baton 17 out in a forward direction with the above described forward hand stroke. Also, the FIG. 8 view shows the KYDEX ring 2 at maximum tension. After the baton 17 is clear of the longitudinal break 15, the ring forcefully snaps back, resulting in the production of the loud snapping noise as described above.

It is important to note that the motion of the hand 35 from FIGS. 5 through 7 is a single, smooth, and uninterrupted motion, which both releases the closure snap 6 and withdraws the baton 17. In addition to the above described left-side mounted, left hand draw, the advantageous construction of the clip 1 also permits other single-motion withdrawal techniques.

Figure 9:
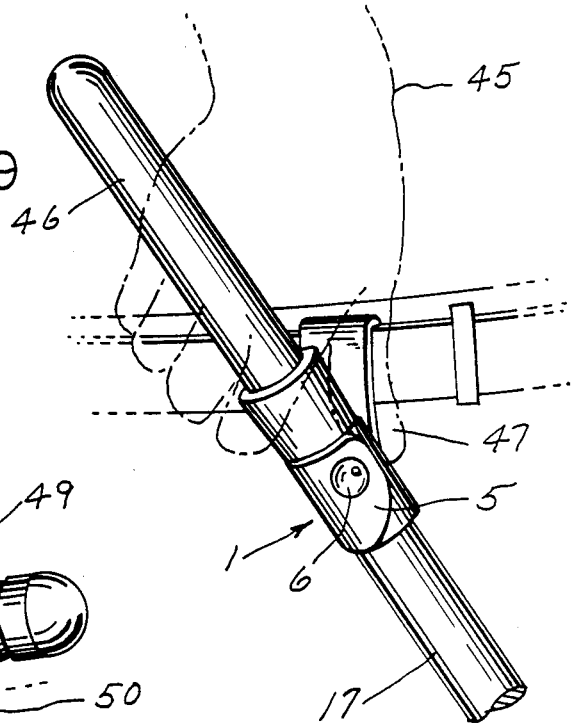
FIG. 9 is a side view of a second operational use of the baton clip of FIG. 1.

For example, FIG. 9 illustrates a left-side mounted baton 17 and clip 1 being deployed by a right hand 45, in a technique referred to in the art as a cross-draw. For the cross-draw technique, the right hand 45 reaches across the user's body, grasping the baton handle 46 between the palm and all four fingers, while the thumb 47 is wedged under the terminal end of closure strap 5. Then, as the hand 45 is moved forward, the thumb 47 releases the closure snap 6 in the same motion which breaks out the baton 17.

Figure 10:
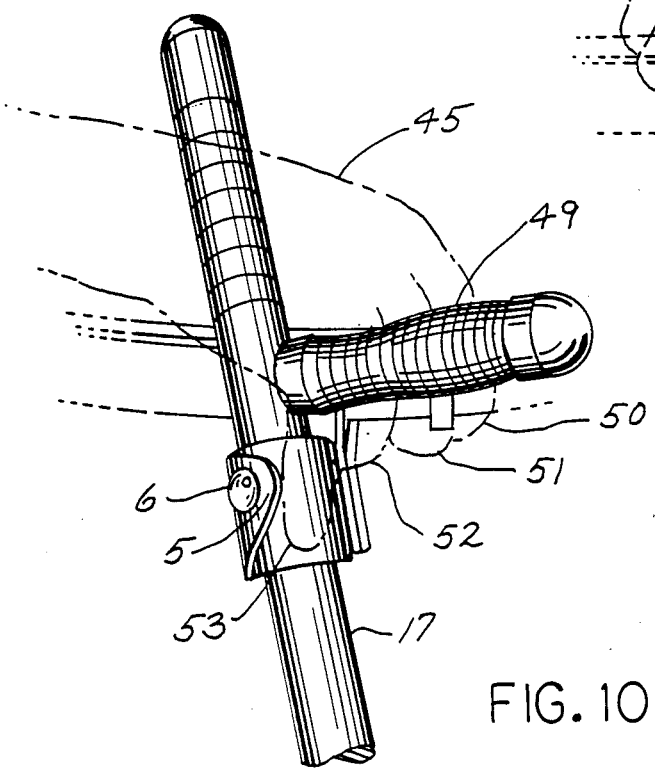
FIG. 10 is a side view of a third operational use of the baton clip of FIG. 1.

A variation of the cross-draw technique can also be used with side handle type batons, as illustrated in FIG. 10. In that case, the right hand 45 reaches across the user's body to grasp the side handle 49 with the thumb (not visible in FIG. 10), index, middle, and ring fingers 50–52, respectively. The little finger 53, however, is extended downward to wedge under the terminal end of closure strap 5. Again, forward motion of the hand 45 both releases the closure snap 6 and breaks out the baton 17.

We claim:

1. In a baton clip of the type which includes a base member, a retaining band attached to the base member, the retaining band having a generally cylindrical shaped wall member when in a relaxed state, and having a longitudinal slit extending through the wall member defining two longitudinal engaging edges which form a longitudinal break in the generally cylindrical shaped wall member in the relaxed state, the retaining band being adapted for holding the baton by slidably inserting the baton therethrough, and the retaining band being deformable to allow the baton to be broken out laterally through the longitudinal break, the improvement wherein:

the longitudinal edges are formed of a hard material; and the retaining ring has a high restorative force toward the relaxed state;

whereby when the baton is broken out through the longitudinal break, and after the baton has cleared the longitudinal edges, the retaining band sharply restores toward the relaxed state, thrusting the hard longitudinal edges together with sufficient velocity to produce a loud snapping sound.

2. The improvement as recited in claim 1 in which:

the retaining band is attached to the base member in such a way that the longitudinal break is oriented in a generally front facing position, and the retaining band includes a first half of a unidirectional snap positioned near the outer rear quadrant of the retaining band; and the clip includes a closure strap attached to the base member, extending around the front of the retaining band and terminating in a terminal end, the closure strap including a second half of a unidirectional snap near the terminal end which mates to the first snap half on the retaining band, the two unidirectional snap halves being oriented such that a release point of the snap halves is directed toward the terminal end of the closure strap, the closure strap thereby preventing the baton from being broken out through the longitudinal break when the two snap halves are engaged, and the closure strap being formed of a pliable material which allows the closure strap to deflect outwardly allowing break out of the baton when the two snap halves are released;

wherein a single uninterrupted stroke of the users hand is able to both firstly wedge a digit of the users hand under the terminal end of the closure strap to release the two snap halves and then secondly continue the stroke to break out the baton through the longitudinal break in fluent succession.

3. The improvement as recited in claim 2 in which the clip further includes an attachment strap connected on one end to the base member and including a second snap for releasably connecting the other end of the attachment strap to the base member, thereby defining belt loop suitable for encircling a belt worn by the user, and in which the base member, closure strap, and attachment are all formed from a single L-shaped piece of material.

4. The improvement as recited in claim 1 in which the retaining ring is formed of hard, resilient plastic material, and has an axial length of at least 1.5 inches.

* * * * *